US008997371B2

(12) United States Patent
Böhn

(10) Patent No.: US 8,997,371 B2
(45) Date of Patent: Apr. 7, 2015

(54) DEVICE FOR THE FLOW-THROUGH TREATMENT OF WEB-SHAPED MATERIAL

(75) Inventor: Markus Böhn, Hainburg (DE)

(73) Assignee: Trützschler Nonwovens & Man-Made-Fibers GmbH, Egelsbach (DE)

( * ) Notice: Subject to any disclaimer, the term of this patent is extended or adjusted under 35 U.S.C. 154(b) by 252 days.

(21) Appl. No.: 13/640,749

(22) PCT Filed: Mar. 19, 2011

(86) PCT No.: PCT/DE2011/000293

§ 371 (c)(1),
(2), (4) Date: Oct. 12, 2012

(87) PCT Pub. No.: WO2011/127885

PCT Pub. Date: Oct. 20, 2011

(65) Prior Publication Data

US 2013/0025150 A1 Jan. 31, 2013

(30) Foreign Application Priority Data

Apr. 15, 2010 (DE) ..... 10 2010 015 080
Apr. 27, 2010 (DE) ..... 10 2010 018 357

(51) Int. Cl.
*F26B 13/16* (2006.01)

(52) U.S. Cl.
CPC ..... *F26B 13/16* (2013.01)

(58) Field of Classification Search
USPC ..... 34/117, 119, 120, 122, 124; 162/227, 162/359.1, 358.1; 264/112, 113, 121
See application file for complete search history.

(56) References Cited

U.S. PATENT DOCUMENTS 3,672,010 A * 6/1972 Fleissner ..... 26/92
4,592,943 A * 6/1986 Cancian et al. ..... 428/171

(Continued)

FOREIGN PATENT DOCUMENTS

DE 1 779 862 9/1971
DE 39 05 001 A1 8/1990

(Continued)

*Primary Examiner* — Steve M Gravini
(74) *Attorney, Agent, or Firm* — Antonelli, Terry, Stout & Kraus, LLP.

(57) ABSTRACT

The invention relates to a device for the flow-through treatment of web-shaped, gas-permeable material, in particular for drying woven or non-woven fabrics, having the following characteristics:

a sieving drum (5), which is rotatably supported and which is connected to a vacuum generator and which has a permeable outer circumference, wherein the material web (M) to be treated rotates around part of the outer circumference of the sieving drum (5);

a treatment chamber (BH), which accommodates the sieving drum and to which the gas to be treated, preferably heated air, is supplied;

inside the treatment chamber (BH), a sieving cover (SD) or corresponding flow-conducting elements, which surround the sieving drum (5) in the area around which the material web (M) is wound and by means of which the gas flowing into the treatment chamber (BH) is conducted in the direction of the sieving drum surface.

According to the invention, the wall (W) of the treatment chamber (BH) facing the outer circumference of the sieving drum (S) in the area around which the material web (M) is wound has a decreasing distance (a1, a2, a3) from the surface of the sieving drum (S) in said area.

11 Claims, 9 Drawing Sheets

(56) References Cited

U.S. PATENT DOCUMENTS

| | | | | | |
|---|---|---|---|---|---|
| 5,020,241 | A | | 6/1991 | Fleissner | |
| 5,570,594 | A | * | 11/1996 | Fleissner | 68/5 D |
| 5,625,962 | A | * | 5/1997 | Fleissner | 34/446 |
| 5,678,321 | A | * | 10/1997 | Deshpande et al. | 34/115 |
| 6,199,296 | B1 | * | 3/2001 | Jewitt | 34/115 |
| 6,378,226 | B1 | | 4/2002 | Fleissner | |
| 7,841,103 | B2 | * | 11/2010 | Hada et al. | 34/119 |
| 7,955,536 | B2 | * | 6/2011 | Sawyer et al. | 264/112 |
| 2013/0025150 | A1 | * | 1/2013 | Bohn | 34/92 |

FOREIGN PATENT DOCUMENTS

| | | | | | |
|---|---|---|---|---|---|
| EP | 1 048 914 | A2 | | 11/2000 | |
| EP | 2633251 | | * | 9/2013 | |
| GB | 913723 | | | 12/1962 | |
| GB | 1208840 | | | 10/1970 | |
| WO | WO02070778 | A1 | * | 9/2002 | C23C 16/00 |
| WO | WO 2012055732 | | * | 5/2012 | |

* cited by examiner

DEVICE FOR THE FLOW-THROUGH TREATMENT OF WEB-SHAPED MATERIAL

BACKGROUND OF THE INVENTION

The invention refers to a device for flow-through treatment, in particular for drying web-shaped material, i.e., gas permeable material, in particular for drying woven or non-woven fabrics.

DE 39 05 001 A1 discloses a sieve drum device for the through-flow heat treatment of gas-permeable material webs. A sieve drum is rotatably supported in a housing, the sieve drum supporting the material web and being designed to have a permeable outer circumference. The sieve drum is subjected to an induced draft by means of a fan that is associated to an end face and acts as a suction air generator. The air drawn off is heated in a part of the housing that is designed as an air treatment unit (fan chamber) and is conducted into the treatment chamber surrounding the sieve drum. Due to the vacuum inside the sieve drum, the heated air flows through the textile material web carried by the sieve drum.

For the purpose of achieving uniformization of the flow in the area of the sieve drum around which the material web is wrapped, this sieve drum is associated with a bowl-shaped sieve cover in the area of the wrap, the sieve cover covering the periphery of the sieve drum. In the operating position, the sieve cover is concentric with the sieve drum axis, i.e. the sieve cover extends parallel to the sieve drum surface. Due to the sieve cover in the form of a perforated metal sheet, a pressure gradient is established between the treatment chamber and the sieve drum.

SUMMARY OF THE INVENTION

Thus, the invention starts from a device for the flow-through treatment of web-shaped, gas permeable material, in particular for drying woven or non-woven fabrics, with the following features:

a sieve drum that is rotatably supported and is connected with a vacuum generator, the sieve drum having a permeable outer circumference, wherein the material web to be treated travels around a part of the outer circumference of the sieve drum, a treatment chamber accommodating the sieve drum, which is exposed to the gas to be treated, preferably heated air, within the treatment chamber, a sieve cover or corresponding flow guide elements are provided surrounding the sieve drum in the area wrapped by the material web, by which the gas flowing in the treatment chamber is directed towards the sieve drum surface.

It is an object of the present invention to improve a device of the generic type.

This object is achieved with the feature that the wall (W) of the treatment chamber (BH), which faces the outer circumference of the sieve drum (S) in the area of wrapping by the material web (M), has, in this area, a decreasing distance to the surface of the sieve drum (S). Advantageous developments of the invention also include that the wall (W) of the treatment chamber facing the material web (M) is a part of the housing surrounding the sieve drum (S), that the wall (W) of the treatment chamber (BH) facing the material web (M) extends in a curved shape, that the wall (W) of the treatment chamber (BH) facing the material web (M) extends in the form of successive straight surface sections in the manner of a polygonal line, that the sieve drum (S) comprises an expansion chamber (E) at a front face thereof, the chamber being connected with a vacuum generator (LA) and having an inner diameter (dE) larger than the inner diameter (dS) of the sieve drum, that the sieve drum (S) comprises a respective expansion chamber (E) at both front faces, that the two expansion chambers (E) of the sieve drum (S) are connected with an air treatment unit (LA) via air guiding ducts (L), and that the two expansion chambers (E) of the sieve drum (S) are connected with a respective air treatment unit (LA) via air guiding ducts (L).

BRIEF DESCRIPTION OF THE SEVERAL VIEWS OF DRAWINGS

DISCLOSURE OF THE INVENTION

Figure 1:
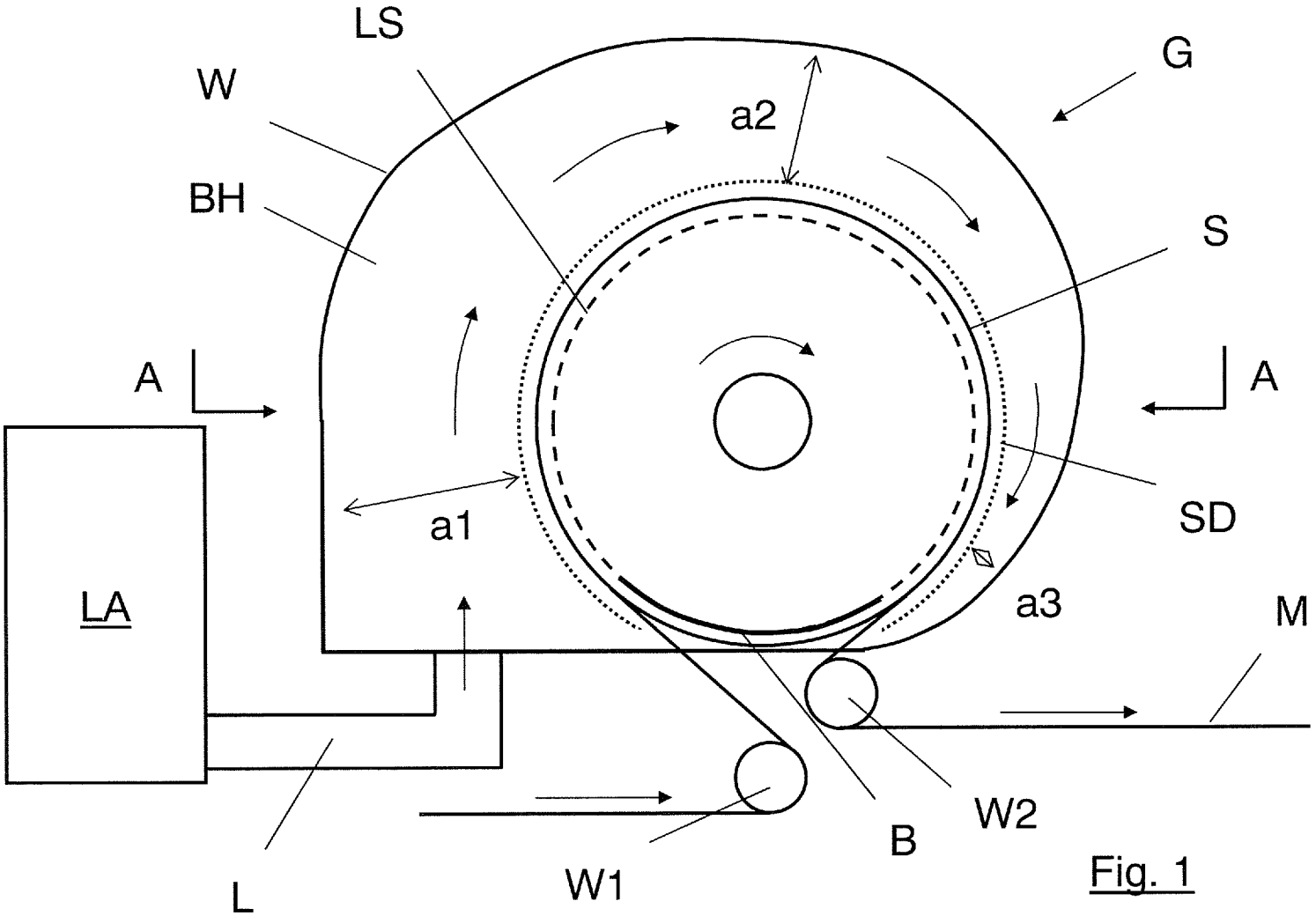
FIG. 1 shows an embodiment of a sieve drum with an air permeable outer circumferential surface.

According to the invention it is provided that:

the wall of the treatment chamber, which faces the outer circumference of the sieve drum in the area of wrapping by the material web, has, in this area, i.e. seen along the circumference of the sieve drum, a decreasing distance to the surface of the sieve drum or the sieve cover surrounding the sieve drum, respectively, or the flow guiding elements surrounding the sieve drum.

According to one embodiment of the invention, the treatment chamber extends substantially in the manner of a helix, seen with respect to the direction of sieve drum rotation, approaching the sieve drum surface in the rearward direction. If the area of the treatment chamber of the present invention, which extends over the sieve drum, were developed on a plane, the treatment chamber would be wedge-shaped. This taper of the treatment chamber gives consideration to the fact that, given a uniform suction of the material web wrapped around the sieve drum, only a small quantity of gas has to flow in the rear portion of the treatment chamber. In this case, the supply of air to the treatment chamber always takes place in the area where the wall of the treatment chamber has the largest distance to the sieve drum surface.

The traveling direction of the web, and thus the direction of sieve drum rotation, may extend in the direction of the tapering treatment chamber, i.e. the material web to be dried enters the area of the treatment chamber where the wall thereof has a large distance to the sieve drum surface. Seen in the traveling direction of the web, the wall distance then decreases—the treatment chamber becomes smaller. Basically, an oppositely directed travel of the material web is possible. The material enters the narrow area of the treatment chamber—the same widens in the direction of sieve drum rotation.

Seen across the working width of the sieve drum, the treatment chamber may present a constant distance to the sieve drum surface. It is also possible that the wall delimiting the treatment chamber has another distance in the center of the sieve drum width than at the edges.

Inside the treatment chamber of the present invention, the sieve drum surface is surrounded by a sieve cover or flow guiding elements, such that the gas flow in the treatment chamber is turned into a flow running substantially vertically relative to the sieve drum surface. Here, the sieve cover may have a constant perforation across the width and/or along the length thereof. For the generation of a desired flow distribution, it is also possible to configure the perforation in the sieve cover differently both across the width and in the circumferential direction. Here, the size of the holes and/or the shape of the holes and/or the distribution can vary. Thereby, it is possible, for example, to achieve a constant thorough suctioning of the material web across the width.

The deflection of the gas flow in the treatment chamber to become the through-flow in the area of the material web/sieve drum surface may also be achieved by means of appropriately designed flow guiding elements. These may be baffles arranged sequentially in the circumferential direction of the sieve drum, or streamline guiding bodies that are arranged as bars above the drum surface, extending across the width of the drum.

The following developments are provided:

the wall of the treatment chamber facing the material web is a part of the housing surrounding the sieve drum.

the wall of the treatment chamber facing the material web is in the form of a curve.

the wall of the treatment chamber facing the treatment chamber is in form of straight surface sections arranged in a row in the manner of a polygonal line.

the wall of the treatment chamber facing the material web is adjustable.

An embodiment will be explained hereunder with reference to the drawings.

FIG. 1 shows a sieve drum S with an air permeable outer circumferential surface. The sieve drum S is rotatably supported in a housing G and is connected with a suction air generator in a manner not illustrated. The sense of rotation of the sieve drum S is identified by the arrow. The inside of the housing G forms a treatment chamber BH for a material web M to be dried.

A material web M, for example a non-woven web, is guided around a part of the outer circumferential surface of the sieve drum S. In order to obtain as large a wrapping of the sieve drum S as possible, the material web M is guided into the housing G via a roll W1 and to outer circumference of the sieve drum S, and is taken from the outer circumference via a second roll W2 and is guided out of the housing G. The traveling direction of the material web M is indicated by the arrows. In the area not wrapped by the material web M, a screen B is arranged within the sieve drum S in a manner fixed to the base, by which suctioning is prevented in this area. An air guiding structure LS in the form of a perforated metal sheet is also arranged inside the sieve drum S in a manner fixed to the base. Inside the treatment chamber BH, a sieve cover SD in the form of a perforated metal sheet is arranged above the area of the sieve drum S wrapped by the material web M. The sieve cover SD is fixed to the base, i.e. it is fixedly connected with the housing G.

The housing G surrounding the sieve drum S is connected with an air treatment unit LA via a piping system L, the unit comprising a fan drawing the air from the sieve drum S and heating it up. A part of the air from the sieve drum S is guided into the environment as exhaust air—correspondingly, fresh air is supplied. Thus, the humidity expelled from the material web is discharged. The piping system L is designed such that the air supplied to the inside of the housing G—the treatment chamber BH—flows in uniformly across the width of the sieve drum S.

The wall W of the housing G delimiting the treatment chamber BH in the area of the wrapping of the material web M extends shaped as a curve approaching the outer circumference of the sieve drum S, such that, seen in the direction of rotation of the sieve drum S, the distance a1, a2, a3 to the outer circumference of the sieve drum S (or to the sieve cover SD or the flow guiding elements surrounding the sieve drum S) decreases continuously. The treatment chamber BH between the wall W of the housing G and the outer circumference of the sieve drum S thus tapers in the direction of rotation of the sieve drum S.

The air supplied in the area of the inlet of the material web M via the piping system L flows in the direction of the arrows, following the direction of rotation of the sieve drum S, and is deflected by the vacuum in the drum S first through the sieve cover SD towards the drum S and is drawn through the material web M. Here, the flow spreads uniformly across the width of the drum S within the treatment chamber. The treatment chamber tapering in the direction of drum rotation reflects the quantity of air sucked through, stabilizes the uniform flow and leads to a drying result that can be attained with reduced energy effort (heating power, air quantity) and is uniform across the width of the material web M.

Figure 2:
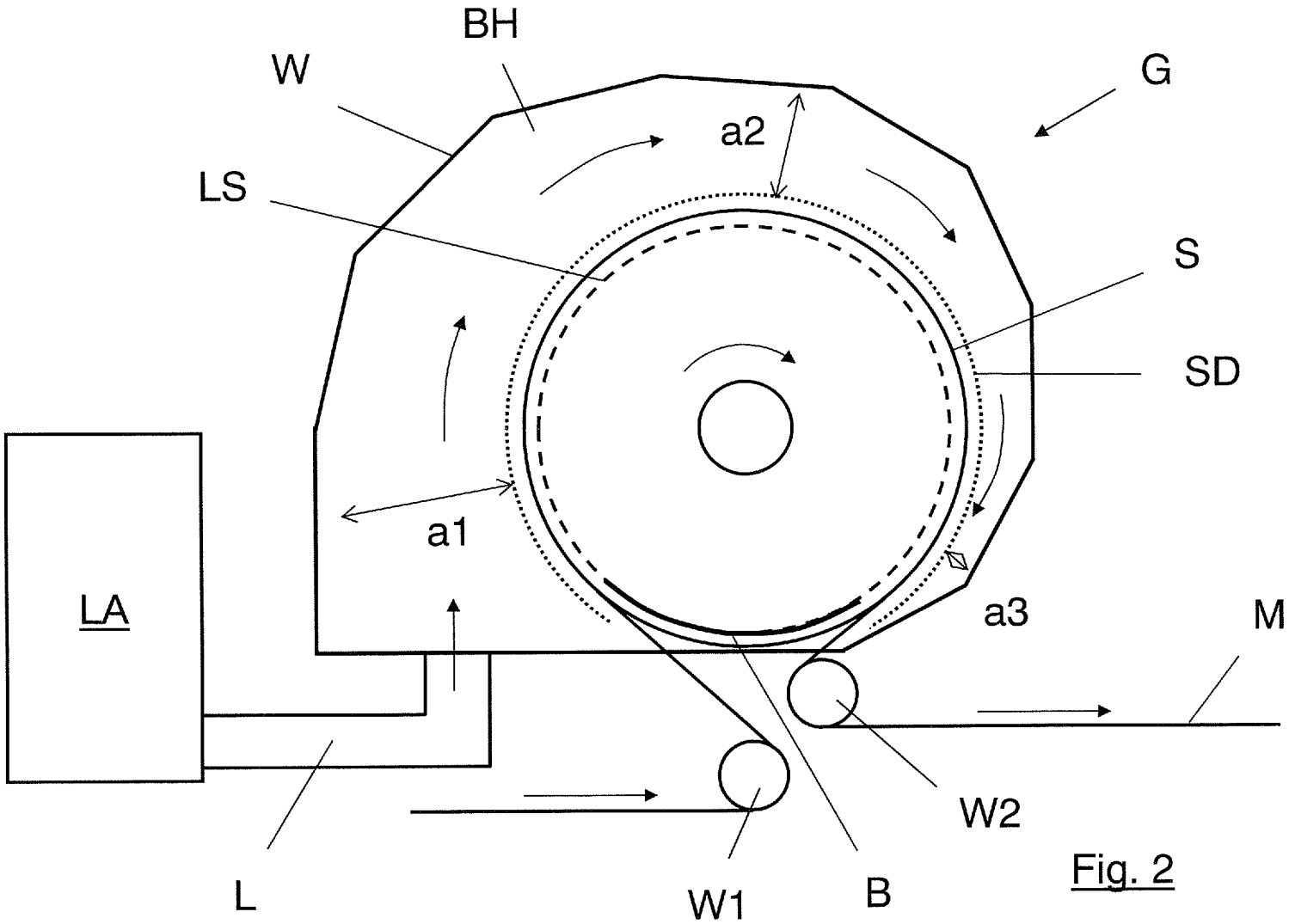
FIG. 2 shows another embodiment of a sieve drum with an air permeable outer circumferential surface.

In the embodiment of FIG. 2, the wall W delimiting the treatment chamber BH is formed, in the area of the wrapping by the material web M, by surfaces that are planar, in sections, and approach the outer circumference of the sieve drum S in the manner of a polygon line. In this embodiment the distance a1, a2, a3 also decreases continuously towards the outer circumference of the sieve drum S, seen in the direction of rotation of the sieve drum S.

Figure 3:
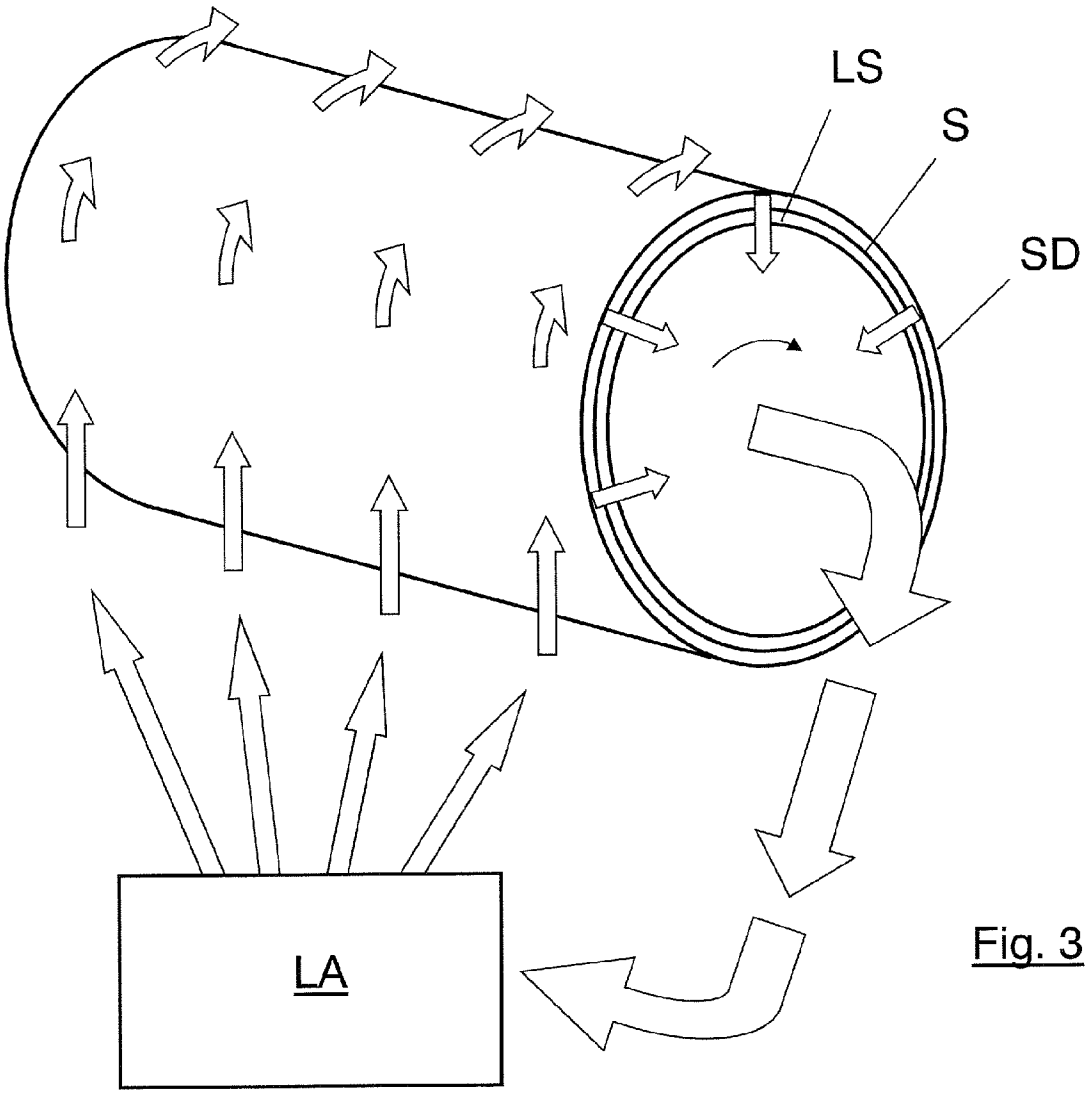
FIG. 3 is a schematic illustration of the flow of air within the treatment chamber.

FIG. 3 is a schematic illustration of the flow of air within the treatment chamber BH in the area above the sieve cover SD stretching over the sieve drum S. The sieve drum S is subjected to vacuum by means of a fan located in the air treatment unit LA. As described above, in the air treatment init LA, the air drawn off is mixed with fresh air and is heated. The heated air is then supplied into the treatment chamber surrounding the sieve drum S above the sieve cover SD, such that the air flow above the sieve cover SD essentially follows the surface of the rotating sieve drum.

Figure 4:
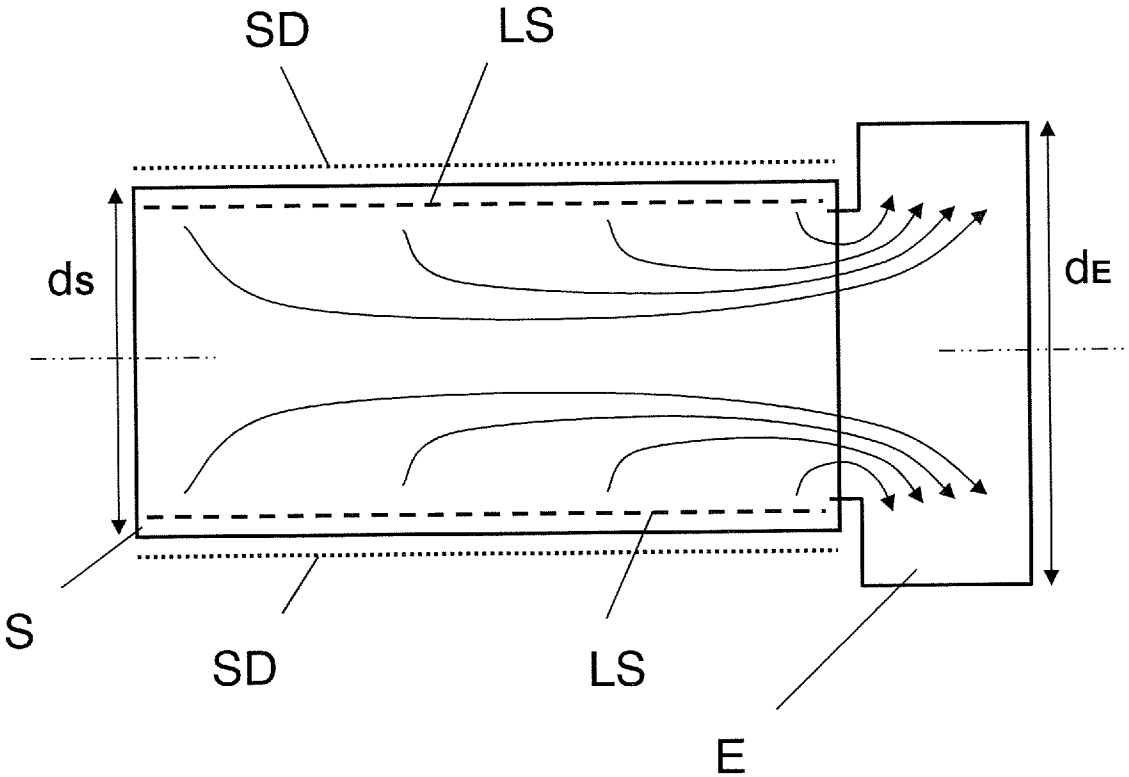
FIG. 4 shows the sieve drum in top plan view, in particular as a section A-A as indicated in FIG. 1.

FIG. 4 shows the sieve drum S in top plan view, in particular as a section A-A as indicated in FIG. 1. The air flowing into the sieve drum S is drawn via an expansion chamber E arranged laterally of the sieve drum S, the interior thereof being arranged concentrically with the axis of the sieve drum S. The inner diameter $d_E$ of the expansion chamber is larger than the inner diameter $d_S$ of the sieve drum S. This allows for an optimal outflow of the air from the sieve drum S—indicated by the flow arrows in FIG. 4. In particular, a uniformization of the induced draft across the width of the sieve drum is achieved thereby. The expansion chamber E is connected with the air treatment unit LA, not illustrated, via an air duct.

Figure 5:
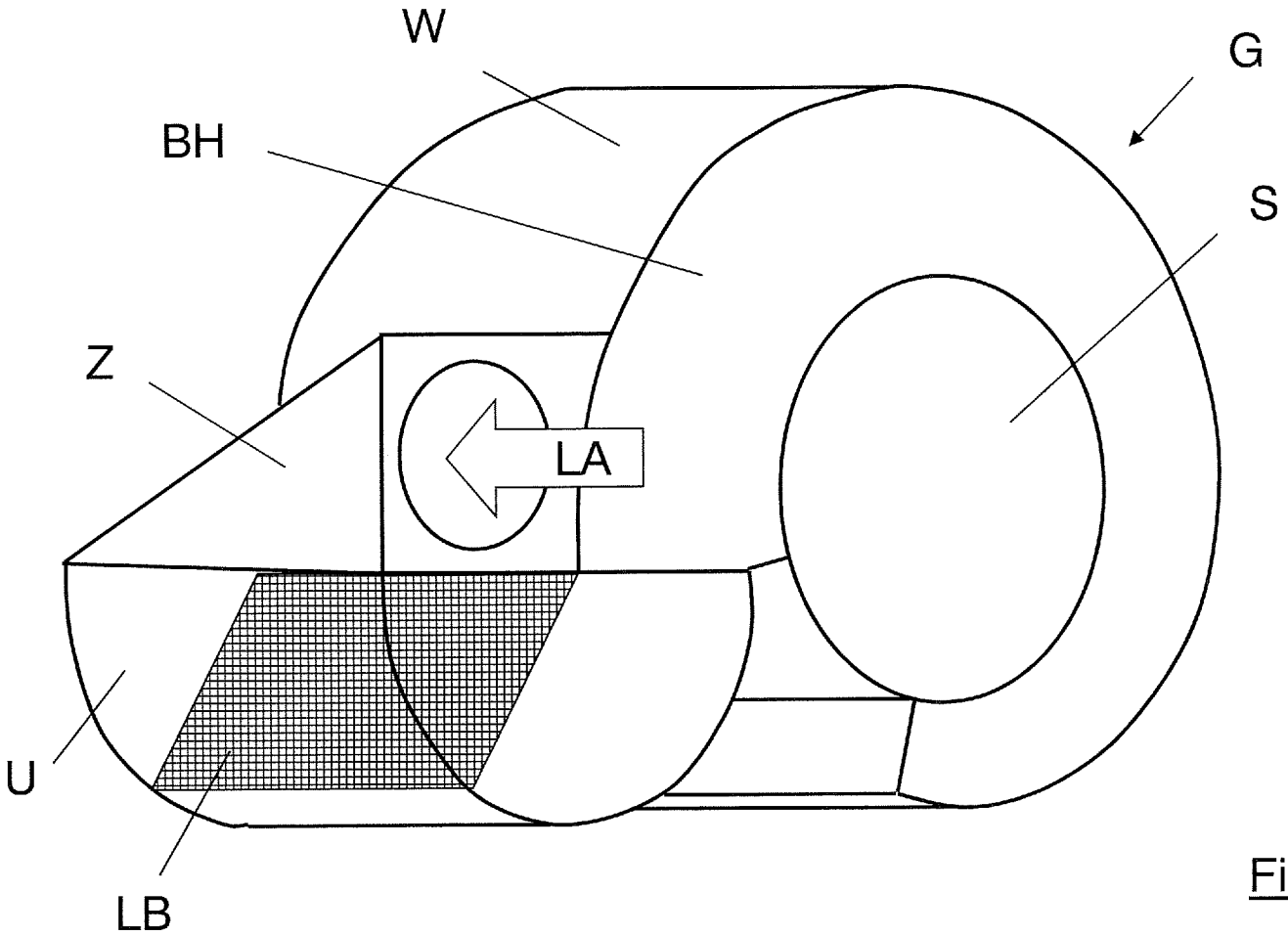
FIG. 5 illustrates an embodiment of the air supply to the treatment chamber.

FIG. 5 illustrates an embodiment of the air supply to the treatment chamber BH. The housing G encloses the sieve drum S with a wall W that approaches the surface of the sieve drum S in helical manner, and thus forms the treatment chamber BH. The air coming from the air treatment unit LA, not illustrated, is supplied via a first supply chamber Z with a top lowering in the manner of a wedge to an adjoining deflection chamber U below the supply chamber Z. At the bottom side, the treatment chamber BH is supplied with air via the deflection chamber U in the area, where the wall W has the greatest distance to the surface of the sieve drum S (see FIGS. 1 and 2). The supply chamber Z, the deflection chamber U and the treatment chamber BH have the same width—the working width of the sieve drum S. For the purpose of a uniformization of the flow, a perforated sheet structure LB or corresponding suitable air guiding elements are arranged inside the deflection chamber U. This perforated sheet structure LB causes a uniform supply of air to the treatment chamber BH.

Figure 6:
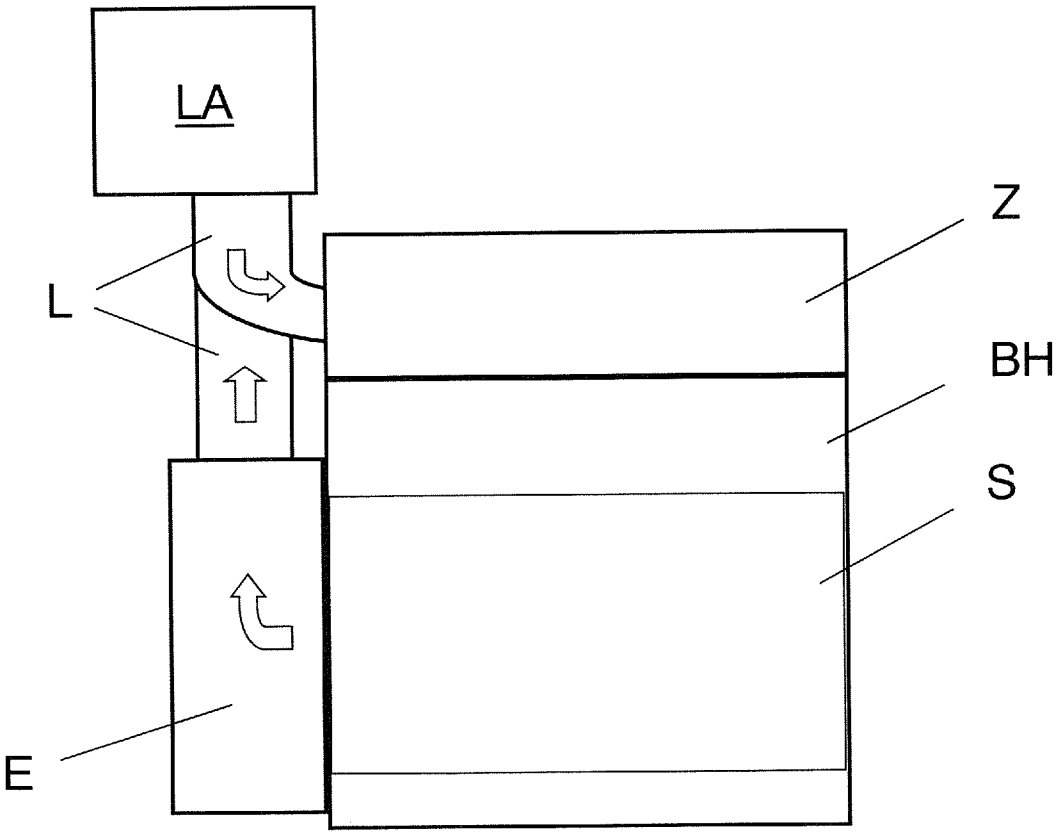
FIG. 6 illustrates a possible way of recirculating the circulating air.

FIG. 6 illustrates a possible way of recirculating the circulating air, i.e. how air is recirculated from the air treatment unit LA into the treatment chamber BH. The Figure shows the arrangement of the described parts that serve to convey air, such as the treatment chamber BH, the expansion chamber E, the air duct L, the supply chamber Z and the air treatment unit LA, in top plan view (as compared with the perspective view in FIG. 5). According to this version, the recirculation of circulating air is unilateral—the expansion chamber E is associated to one side of the sieve drum S or the treatment chamber BH. The air guiding direction is identified by an outlined arrow, respectively. Basically, the expansion chamber E could also be arranged on the side of the sieve drum S opposite the circulating air recirculation (air treatment LA, air duct L, supply chamber Z).

Figure 7:
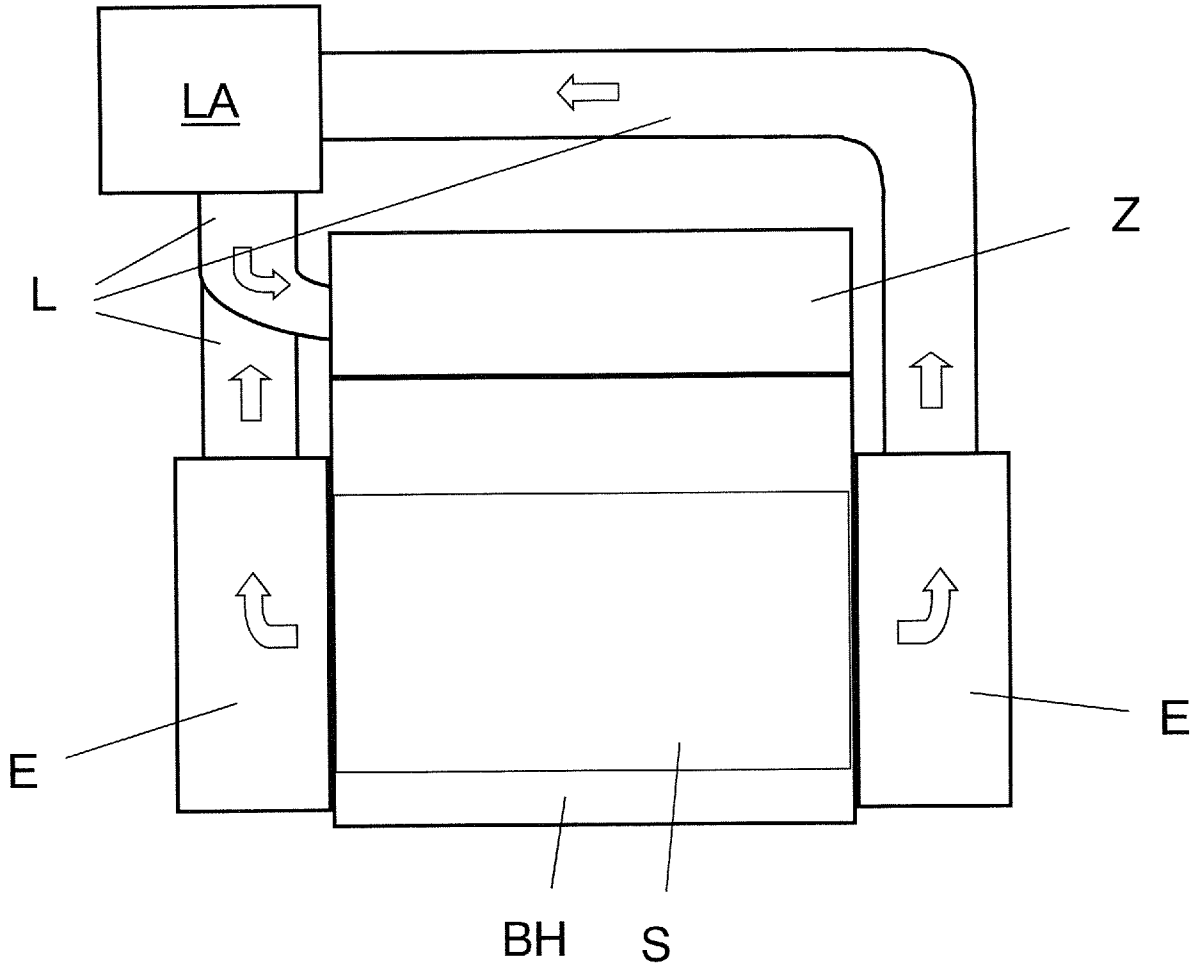
FIG. 7 illustrates a bilateral circulating air recirculation.

A bilateral circulating air recirculation is also possible—the same is illustrated in FIG. 7. A respective expansion chamber E is associated to the front faces of the sieve drum S.

Figure 8:
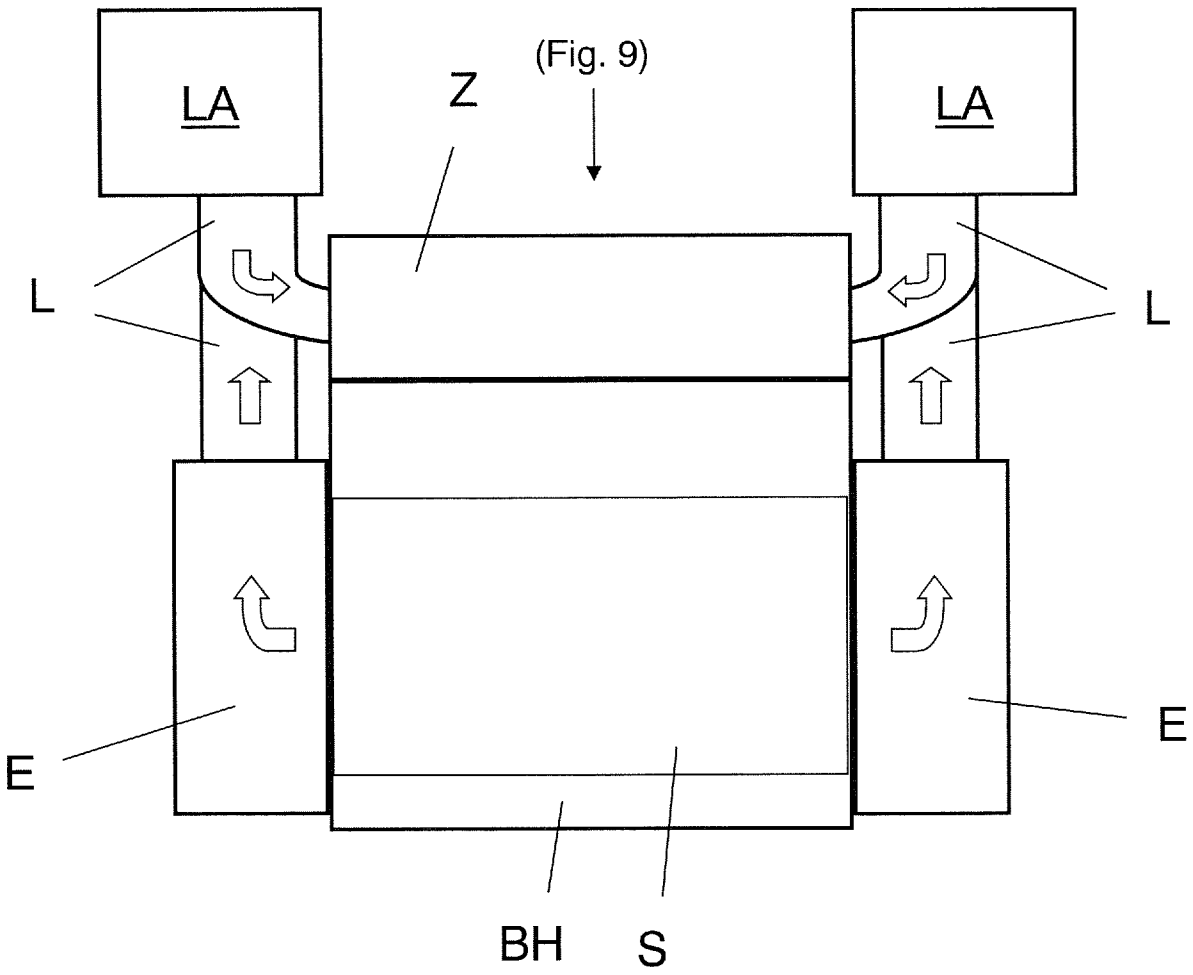
FIG. 8 illustrates bilateral circulating air recirculation in which two air treatment units and two expansion chambers are provided.

Further, FIG. 8 illustrates bilateral circulating air recirculation in which two air treatment units LA and two expansion chambers E are provided. The two front faces of the sieve drum S are associated to a respective expansion chamber from which the air is supplied to a respective air treatment unit LA.

Figure 9:
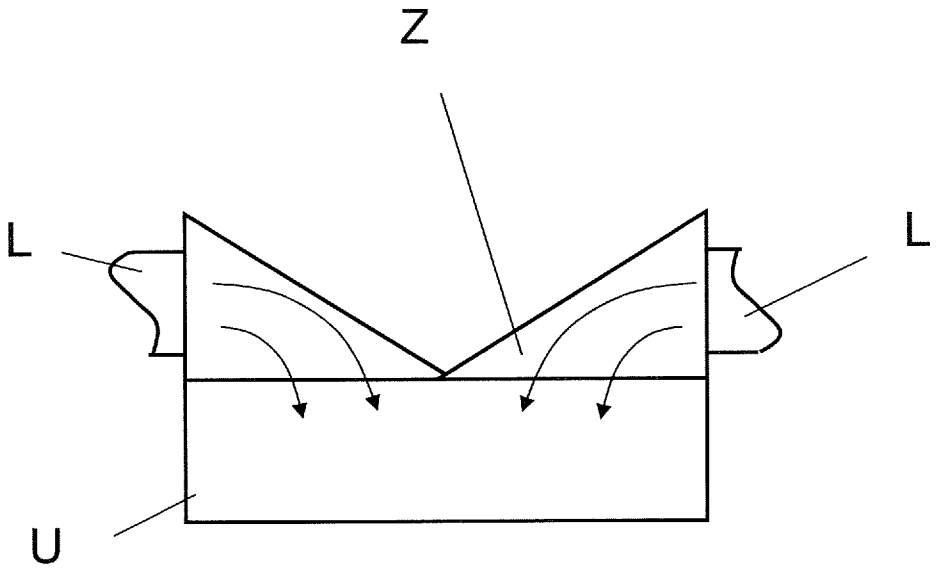
FIG. 9 illustrates the supply chamber Z forming part of the bilateral circulating air recirculation seen in the direction of the arrows in FIG. 8.

Finally, seen in the direction of the arrows in FIG. 8, FIG. 9 illustrates the supply chamber Z forming part of the bilateral circulating air recirculation. The supply chamber Z has a respective air guiding duct L at both ends and is supplied with air from the respective air treatment unit (not illustrated). The top of the supply chamber is sloped downwards from the sides to the middle so that the chamber comprises two wedge-shaped areas. As indicated by the flow arrows, the air supplied from both sides is fed uniformly across the width into the deflection chamber U, situated below the supply chamber Z, and from there into the adjoining treatment chamber BH.

LIST OF REFERENCE NUMERALS

S sieve drum
M material web
W1, W2 roll
G housing
BH treatment chamber
LS air guiding structure (fixed to the base—within the sieve drum)
SD sieve cover
LS air guiding structure
W wall
B screen (fixed to the base—within the sieve drum)
L duct, duct system, air guiding duct
LA air treatment, vacuum generator
E expansion chamber
Z supply chamber
U deflection chamber
LB perforated metal sheet
a1, a2, a3 distance sieve drum surface/sieve cover—wall W
$d_S$ diameter sieve drum
$d_E$ diameter expansion chamber

The invention claimed is:

1. A device for the flow-through treatment of web-shaped, gas permeable material, comprising:

a sieve drum that is rotatably supported and is connected with a vacuum generator, the sieve drum having a permeable outer circumference, wherein the material web to be treated travels around a part of the outer circumference of the sieve drum, a treatment chamber accommodating the sieve drum, which is exposed to gas to be treated, and within the treatment chamber, a sieve cover or corresponding flow guide elements are provided surrounding the sieve drum in the area wrapped by the material web, by which the gas flowing in the treatment chamber is directed towards the sieve drum surface, wherein the wall of the treatment chamber, which faces the outer circumference of the sieve drum in the area of wrapping by the material web, has, in this area and as seen in a direction of rotation of the sieve drum, a decreasing distance to the surface of the sieve drum such that a distance to the surface of the sieve drum at a beginning of the area of wrapping by the material web is greater than a distance to the surface of the sieve drum at an end of the area of wrapping by the material web.

2. The device of claim 1, wherein the wall of the treatment chamber facing the material web is a part of the housing surrounding the sieve drum.

3. The device of claim 1, wherein the wall of the treatment chamber facing the material web extends in a curved shape.

4. The device of claim 1, wherein the wall of the treatment chamber facing the material web extends in the form of successive straight surface sections in the manner of a polygonal line.

5. The device of claim 1, wherein the sieve drum comprises an expansion chamber at a front face thereof, the chamber being connected with a vacuum generator and having an inner diameter larger than the inner diameter of the sieve drum.

6. The device of claim 5, wherein the sieve drum comprises a respective expansion chamber at both front faces.

7. The device of claim 6, wherein the two expansion chambers of the sieve drum are connected with an air treatment unit via air guiding ducts.

8. The device of claim 6, wherein the two expansion chambers of the sieve drum are connected with a respective air treatment unit via air guiding ducts.

9. The device of claim 1, wherein, in the area of wrapping by the material web and as seen in the direction of rotation of the sieve drum, the distance to the outer circumference of the sieve drum decreases continuously.

10. The device of claim 1, wherein, in the entire area of wrapping by the material web and as seen in the direction of rotation of the sieve drum, the distance to the outer circumference of the sieve drum decreases continuously.

11. The device of claim 1, wherein the gas to be treated is heated air.

* * * * *